US008436520B2

(12) United States Patent
Ma

(10) Patent No.: US 8,436,520 B2
(45) **Date of Patent: *May 7, 2013**

(54) ELECTRODE MATERIAL FOR USE WITH A SPARK PLUG

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 4 days.

This patent is subject to a terminal disclaimer.

(21) Appl. No.: 13/193,121

(22) Filed: Jul. 28, 2011

(65) Prior Publication Data

US 2012/0025692 A1 Feb. 2, 2012

Related U.S. Application Data

(60) Provisional application No. 61/368,860, filed on Jul. 29, 2010.

(51) Int. Cl.
*H01T 13/39* (2006.01)
*H01T 13/34* (2006.01)

(52) U.S. Cl.
USPC ..... 313/141; 313/143

(58) Field of Classification Search ..... 313/118–145
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Fletcher |
| 3,528,862 | A | 9/1970 | Jones et al. |
| 3,868,430 | A | 2/1975 | Giangaspero |
| 3,957,451 | A | 5/1976 | Rasmussen et al. |
| 3,977,841 | A | 8/1976 | Rasmussen et al. |
| 4,324,588 | A | 4/1982 | Zysk et al. |

(Continued)

FOREIGN PATENT DOCUMENTS

| | | |
|---|---|---|
| DE | 10005559 | 8/2001 |
| GB | 556253 | 9/1943 |

(Continued)

OTHER PUBLICATIONS

Written Opinion & International Search Report for PCT/US11/45767 Mar. 20, 2012, 11 pages.

(Continued)

*Primary Examiner* — Mariceli Santiago
(74) *Attorney, Agent, or Firm* — Reising Ethington P.C.

(57) ABSTRACT

A spark plug for an internal combustion engine has a center electrode, a ground electrode or both that includes an electrode material that is a Pt-based alloy. The electrode material may include platinum (Pt), at least one active element like aluminum (Al) or silicon (Si), and at least one high-melting point element such as ruthenium (Ru), iridium (Ir), tungsten (W), molybdenum (Mo), rhenium (Re), tantalum (Ta), niobium (Nb), chromium (Cr), or a combination thereof. In at least some of the disclosed alloys, the aluminum (Al) and/or silicon (Si) contributes to the formation of a thin protective oxide layer on a surface of the electrode material.

20 Claims, 2 Drawing Sheets

U.S. PATENT DOCUMENTS

| | | | |
|---|---|---|---|
| 4,351,095 | A | 9/1982 | Davies |
| 4,427,915 | A | 1/1984 | Nishio |
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |
| 4,939,409 | A | 7/1990 | Friese et al. |
| 5,101,135 | A | 3/1992 | Oshima |
| 5,347,193 | A | 9/1994 | Oshima |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani |
| 5,890,272 | A | 4/1999 | Liberman |
| 5,894,186 | A | 4/1999 | Matsutani et al. |
| 5,898,257 | A | 4/1999 | Sequerra et al. |
| 5,990,602 | A | 11/1999 | Katoh et al. |
| 5,997,695 | A | 12/1999 | Ilmarinen |
| 5,998,913 | A | 12/1999 | Matsutani et al. |
| 6,045,424 | A | 4/2000 | Chang et al. |
| 6,046,532 | A | 4/2000 | Matsutani et al. |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matsutani et al. |
| 6,262,522 | B1 | 7/2001 | Osamura et al. |
| 6,304,022 | B1 | 10/2001 | Matsutani et al. |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kanao |
| 6,533,628 | B1 | 3/2003 | Matsutani et al. |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 8,274,204 | B2 * | 9/2012 | Ma ..... 313/141 |
| 2002/0024160 | A1 | 2/2002 | Sugimoto |
| 2003/0178925 | A1 | 9/2003 | Kumagai |
| 2004/0140745 | A1 | 7/2004 | Hrastnik |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski et al. |
| 2007/0236124 | A1 | 10/2007 | Lykowski |
| 2008/0074025 | A1 | 3/2008 | Hori |
| 2008/0206601 | A1 | 8/2008 | Mukai |
| 2008/0308057 | A1 | 12/2008 | Lykoski |
| 2010/0026159 | A1 | 2/2010 | Ohm |
| 2010/0052497 | A1 | 3/2010 | Walker, Jr. |
| 2010/0109502 | A1 | 5/2010 | Nakayama |
| 2010/0117506 | A1 | 5/2010 | Suzuki et al. |
| 2010/0253203 | A1 | 10/2010 | Suzuki |
| 2010/0264801 | A1 | 10/2010 | Tanaka |
| 2010/0264802 | A1 | 10/2010 | Tanaka |
| 2011/0043093 | A1 | 2/2011 | Nunome |
| 2011/0127900 | A1 | 6/2011 | Ma |
| 2011/0198983 | A1 | 8/2011 | Manhardt |
| 2012/0025690 | A1 | 2/2012 | Kohl |
| 2012/0025692 | A1 | 2/2012 | Ma |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

International Search Report for PCT/US2010/058501, Aug. 31, 2011, 3 pages.

* cited by examiner

ELECTRODE MATERIAL FOR USE WITH A SPARK PLUG

CROSS-REFERENCE TO RELATED APPLICATION

This application claims the benefit of U.S. Provisional Ser. No. 61/368,860 filed Jul. 29, 2010, the entire contents of which are herein incorporated by reference.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug comprising a metallic shell, insulator, center electrode and ground electrode. The center electrode, the ground electrode, or both includes an electrode material having: platinum (Pt) from about 50 at % to about 99.9 at %, inclusive; at least one active element from about 0.01 at % to about 30 at %, the at least one active element is selected from the group consisting of: aluminum (Al) or silicon (Si); at least one high-melting point element from about 0.01 at % to about 30 at %, inclusive, the at least one high-melting point element is selected from the group consisting of: ruthenium (Ru), iridium (Ir), tungsten (W), molybdenum (Mo), rhenium (Re), tantalum (Ta), niobium (Nb) or chromium (Cr); and a thin oxidation layer formed on or near an electrode surface after the spark plug has been exposed to sufficient heat in a combustion chamber. The thin oxidation layer minimizes a balling or bridging phenomena that can otherwise take place due to excessive evaporation and re-deposition of certain constituents of the electrode material.

According to another embodiment, there is provided an electrode material for use with a spark plug, where the electrode material is similar to that recited above.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in FIGS. 1-5 and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 1:
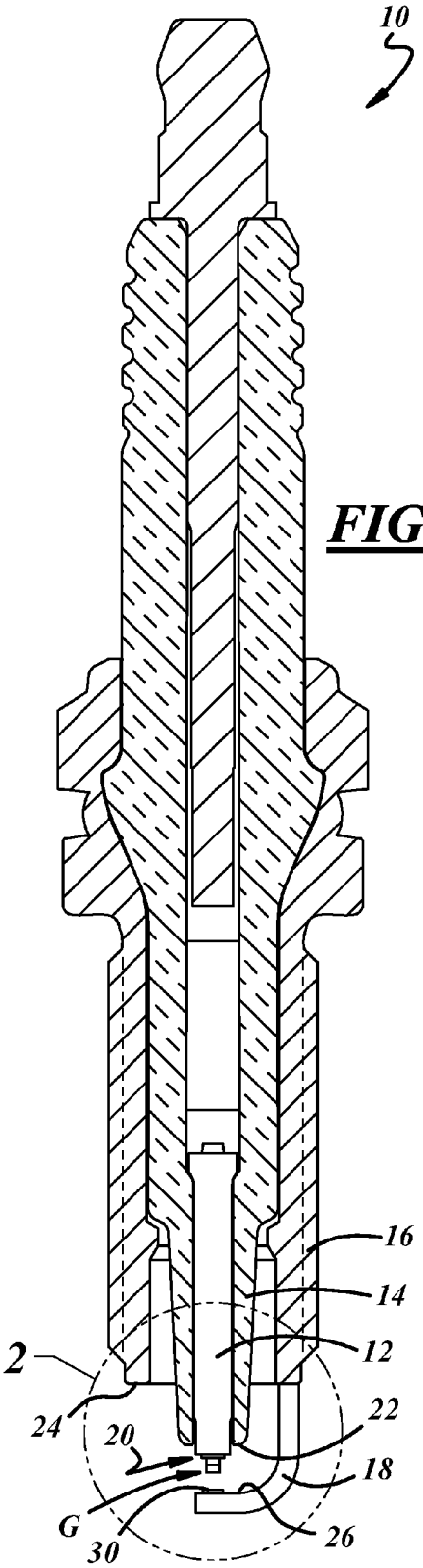
FIG. 1 is a cross-sectional view of an exemplary spark plug that may use the electrode material described below.
Figure 2:
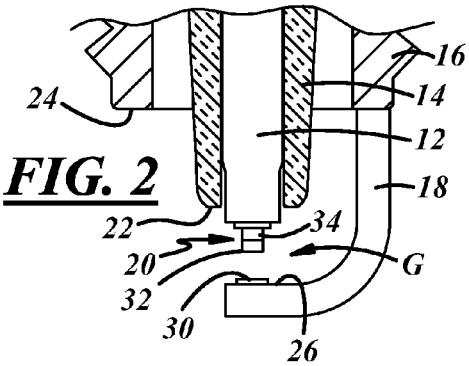
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
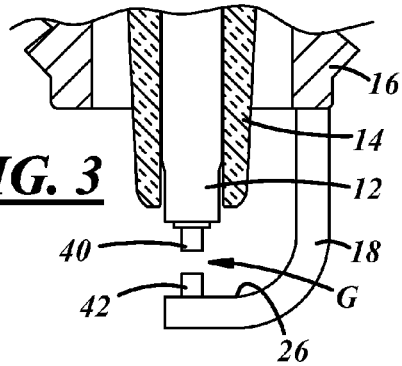
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
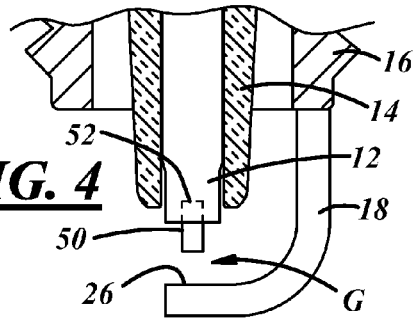
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
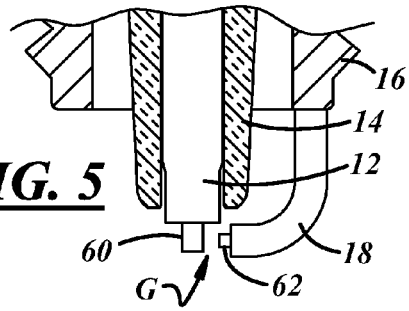
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from the side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and the side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
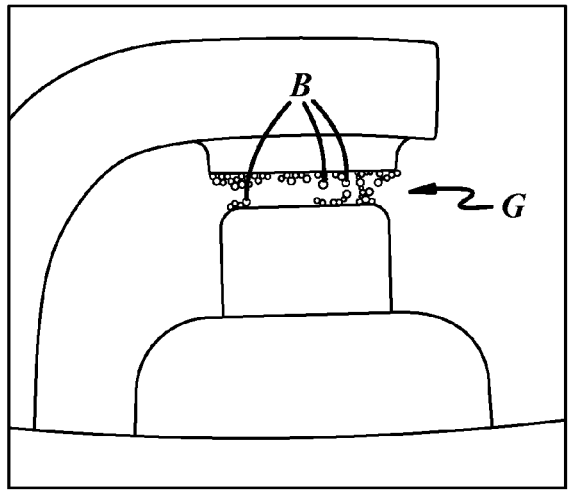
FIG. 6 is schematic representation of a so-called balling and bridging phenomenon at the electrodes of an exemplary spark plug that does not use the electrode material described below.
Figure 7:
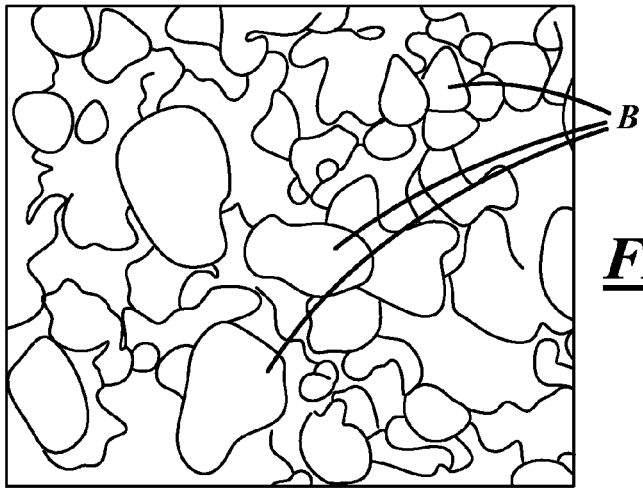
FIG. 7 is enlarged schematic representation of the balling and bridging phenomenon of FIG. 6.
Figure 8:
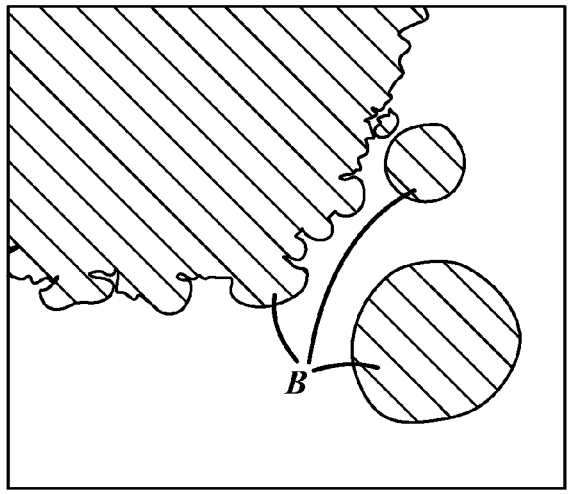
FIG. 8 is a cross-sectional schematic representation of the balling and bridging phenomenon of FIG. 7.

Precious metal alloys, like platinum (Pt) based alloys, have been used for spark plug electrodes. Although Pt-based alloys can exhibit a certain degree of oxidation, corrosion and/or erosion resistance that is desirable in some applications, they can also have some drawbacks. Referring to FIGS. 6-8, for example, it has been discovered that certain Pt-based alloys, like a Pt4W alloy, sometimes experience a so-called balling or bridging phenomenon in which locally excessive oxidation and re-deposition of material creates Pt balls B at a surface thereof. This balling or bridging phenomenon can occur during high temperature operation in an internal combustion engine, and over time the Pt balls B can collect and form a bridge across the spark gap G. When formed, the Pt balls B may negatively affect the spark performance of the spark plug, including causing misfires or the like. It has been found that the electrode materials described below may limit or altogether prevent this balling and/or bridging phenomenon, while maintaining suitable characteristics such as ductility for forming different spark plug electrode shapes. The electrode material may be composed of a high-temperature performance alloy, such as the Pt-based alloy described herein.

According to an exemplary embodiment, the electrode material is a Pt-based alloy and includes platinum (Pt), one or more active elements, and one or more high-melting point elements, where the electrode material has a thin protective oxidation layer that forms on the surface of the material during high temperature operation. The term "Pt-based alloy," as used herein, broadly includes any alloy or other electrode material where platinum (Pt) is the single largest constituent on an atomic % basis. This may include materials having greater than 50% platinum, as well as those having less than 50% platinum, so long as the platinum is the single largest constituent. Skilled artisans will appreciate that platinum has a lower melting temperature (1768° C.) than some precious metals, like iridium (Ir), and that this can lower the erosion resistance of the electrode material. In order to compensate for this, the electrode material described herein may include one or more high-melting point elements, such as ruthenium (Ru), iridium (Ir), tungsten (W), molybdenum (Mo), rhenium (Re), tantalum (Ta), niobium (Nb), chromium (Cr), or a combination thereof. In addition, platinum-based alloys sometimes experience the balling or bridging phenomena described above. The electrode material described herein addresses this potential challenge by including one or more active elements, like aluminum (Al), silicon (Si) or a combination of both. The active elements may contribute to the formation of thin oxidation layers on the surface of the electrode material that can resist or deter the electrode material from forming balls B, as shown in FIGS. 6-8. Platinum (Pt) is rather ductile compared to comparable metals and is therefore better suited for metal forming techniques that form the material into various electrode shapes. Accordingly, the present electrode material or Pt-based alloy may enjoy desirable erosion, corrosion and/or oxidation resistance, avoid balling and bridging effects, yet retain its desirable ductility.

In one embodiment, the electrode material includes platinum (Pt) from about 50 at % to about 99.9 at %, inclusive, at least one active element from about 0.01 at % to about 30 at %, inclusive, and at least one high-melting point element from about 0.01 at % to about 30 at %, inclusive, where the platinum (Pt) is the single largest constituent of the electrode material on an at % basis. Aluminum (Al) and/or silicon (Si) may be the active elements referred to above, and ruthenium (Ru), iridium (Ir), tungsten (W), molybdenum (Mo), rhenium (Re), tantalum (Ta), niobium (Nb) and/or chromium (Cr) may be the high-melting point elements. Examples of suitable electrode material compositions that fall within this exemplary embodiment include those compositions having platinum (Pt) plus one active element selected from the group of aluminum (Al) and silicon (Si), plus one or more high-melting point elements selected from the group of ruthenium (Ru), iridium (Ir), tungsten (W), molybdenum (Mo), rhenium (Re), tantalum (Ta), niobium (Nb) and/or chromium (Cr), such as Pt—Al—Ru, Pt—Si—Ru, Pt—Al—Cr, Pt—Si—Cr, Pt—Al—Ir, Pt—Si—Ir, Pt—Al—W, Pt—Si—W, Pt—Al—Mo, Pt—Si—Mo, Pt—Al—Re, Pt—Si—Re, Pt—Al—Ta, Pt—Si—Ta, Pt—Al—Nb, Pt—Si—Nb, etc. These compositions may have other constituents and may include the following non-limiting examples: Pt-7Al-4Ru, Pt-7Si-4Ru, Pt-7Al-4Cr, Pt-7Si-4Cr, Pt-7Al-4Ru-4Cr, Pt-7Si-4Ru-4Cr, Pt-7Al-10Ru, Pt-7Si-10Ru, Pt-8Al-6Cr-5Ru and Pt-8Si-6Cr-5Ru; other examples are certainly possible. In one particular embodiment, the electrode material is a platinum-based alloy that includes platinum (Pt) from about 75 at % to about 95 at %, inclusive, aluminum (Al) from about 5 at % to about 10 at %, inclusive, and ruthenium (Ru) and/or chromium (Cr) from about 0.1 at % to about 10 at %, inclusive. All percentages and weights listed herein are in terms of atomic weight, which is determined by dividing the number of atoms of a certain element, per unit volume, by the number of atoms of the entire electrode material, per unit volume.

Depending on the particular embodiment, the electrode material may include platinum (Pt) from about 50 at % to about 99.9 at %, inclusive, Pt in an amount greater than 55.0 at %, Pt in an amount greater than 65.0 at %, Pt in an amount greater than 79.0 at %, Pt in an amount less than 95 at %, Pt in an amount less than 94 at %, or Pt in an amount less than 84 at %, to cite several possible examples.

The term "active element," as used herein, includes the elements aluminum (Al) and silicon (Si). The electrode material preferably includes Al, Si or both in an amount that is sufficient to affect the oxidation performance of the electrode material. Preferably, these active element(s) are present in sufficient quantities to improve the oxidation resistance of the electrode material by assisting with the formation of thin oxidation surface layers, like those made of $Al_2O_3$ or $SiO_2$, that prevent the excessive evaporation of platinum (Pt) from the electrode material during use of the spark plug in a combustion chamber. Depending on the particular embodiment, the electrode material may include either aluminum (Al) or silicon (Si) from about 0.01 at % to about 30 at %, inclusive; from about 5.0 at % to about 10 at %, inclusive; Al in an amount greater than 5.0 at %; Al in an amount greater than 6.2 at %; Al in an amount greater than 7.5 at %; Al in an amount less than 10.0 at %; Al in an amount less than 8.2 at %; or Al in an amount less than 6.1 at %, Si in an amount greater than 5.0 at %; Si in an amount greater than 6.1 at %; Si in an amount greater than 8.5 at %; Si in an amount less than 10.0 at %; Si in an amount less than 8.6 at %; or Si in an amount less than 7.2 at %, to cite several possible atomic percentages. Some initial testing has shown that providing an electrode material with Al or Si in amount less than 10 at % (e.g., approximately 7 at %) may be desirable because the relatively low Al content minimizes certain precipitates in the electrode material, which in turn improves the ductility and/or plasticity of the alloy. This improves the formability of the electrode material and may even enable the material to be cold extruded down to a wire diameter of about 0.4-0.7 mm, for example. The thin wire can then be cut or sheared into firing tips and attached to the center and/or ground electrodes. In addition, the relatively low Al content may improve the erosion resistance of the electrode material.

In some examples, the electrode material includes a combination of both Al and Si in a combined amount that is greater than 5.0 at % and less than 10 at %, inclusive—if the combined amount of the active elements is too small, then a sufficient protective oxidation layer may not be formed to protect the platinum (Pt) matrix during spark plug operation; if the combined amount of the active elements is too high, then it can make the oxidation rate too fast and reduce the oxidation resistance of the electrodes. Other factors regarding the adjustment of active element quantities also exist. Some exemplary embodiments of an electrode material that includes both Al and Si includes Al in an amount of greater than 1.0 at % and Si in an amount greater than 4.4 at %; Al in an amount greater than 5.1 at % and Si in an amount greater than 1.2 at %; Al in an amount greater than 2.5 at % and Si in an amount greater than 2.5 at %; Al in an amount less than 8.0 at % and Si in an amount less than 4.0 at %; Al in an amount less than 6.3 at % and Si in an amount less than 3.3 at %; and Al in an amount less than 2.1 at % and Si in an amount less than 9.1 at %, to cite several possibilities. Skilled artisans will appreciate that the precise quantities of the active elements, whether they be aluminum (Al), silicon (Si) or both, can be adjusted to meet the particular needs of the application in which the electrode material is being used. The presence and amount of Al and Si in the electrode material may be detected by a chemical analysis or by viewing an Energy Dispersive Spectra (E.D.S.) of the material. The E.D.S. may be generated by a Scanning Electron Microscopy (S.E.M.) instrument, as is understood by those skilled in the art.

The amount or quantity of active elements in the electrode material may impact or influence the oxidation performance of the material. For example, the presence and thickness of a thin oxidation layer that forms on the outer surface of electrodes or firing tips 20 and/or 30 may be influenced by the quantities of active elements in the electrode material. If the electrode material only includes aluminum (Al) as an active element then the thin oxidation layer will likely include aluminum oxide or alumina ($Al_2O_3$), and if the electrode material only includes silicon (Si) as an active element then the thin oxidation layer will likely have silicon dioxide or silica ($SiO_2$). When the electrode material or Pt-based alloy includes a combination of Al and Si, the oxide layer may include a combination of Al and Si oxides, such as a combination of $Al_2O_3$ and $SiO_2$. Providing Al or Si to the electrode material in the percentages disclosed above can cause a suitably thin oxidation layer to form at an electrode surface with a predetermined thickness, which in turn can provide a sufficient discharge voltage and ablation volume per spark during operation at temperatures of at least about 500° C., such as in an internal combustion engine. The predetermined thickness can vary depending on the specific composition of the electrode material and conditions within the combustion chamber. For example, the predetermined thickness of the thin oxidation layer may be about 0.10 μm to about 10.0 μm. The presence of the thin oxidation layer may be detected by heating the electrode to a temperature of at least about 500° C., and performing a chemical analysis on the electrode or by generating and viewing an Energy Dispersive Spectra (E.D.S.) with an S.E.M. instrument, as is understood by those skilled in the art.

As stated above, the thin oxidation layer or oxide layer typically forms at an outer surface of an electrode when temperatures are at least about 500° C., such as during use of spark plug 10 in an internal combustion engine. In other words, when the electrode material is heated to temperatures of 500° C. or more, a gradient structure may be formed where the bulk of the interior of the electrode material includes active elements (Al, Si or both) in an amount of about 5.0 at % to about 10.0 at % and an outer surface of the electrode (e.g., an outer surface of firing tips 20, 30) that includes the thin oxidation layer with a higher proportion of active elements. Once the thin oxidation layer is formed along the outer surface of the electrode, the thin oxidation layer will generally remain at the outer surface at all temperatures. Before the electrode material is heated to temperatures of at least 500° C., the electrode generally does not exhibit a gradient structure where active elements like Al and Si are gathered or concentrated in a thin oxidation layer along the outer surface of the electrode.

The thin oxidation layer may be present along the entire outer surface of the spark plug electrodes or firing tips 20, 30 or present only at sparking surfaces that are exposed to spark gap G. When a sparking surface comprises a planar surface, the oxide layer typically extends along the planar surface, but this is not necessary. The thin oxide layer may be dense, stable, and have a low formation free energy. The oxide layer also can limit evaporation of platinum (Pt) in the electrode material when the material is exposed to sparks and other extreme conditions of the combustion chamber. The thin oxide layer may also provide improved oxidation resistance that protects the sparking surfaces of electrodes like firing tips 20, 30 from erosion. The thin oxide layer can also help to prevent balling and bridging, which commonly occurs at the sparking surfaces of some Pt-based alloys that lack the active elements taught herein, as explained above in conjunction with FIGS. 6-8.

As stated above, electrode material or Pt-based alloy may also include one or more high melting point element(s) in an amount sufficient to affect or influence the melting point of the electrode material. Some examples of potentially suitable high-melting point elements include ruthenium (Ru), iridium (Ir), tungsten (W), molybdenum (Mo), rhenium (Re), tantalum (Ta), niobium (Nb), chromium (Cr), or a combination thereof. Each high-melting point element preferably has a melting temperature of at least 1700 degrees Celsius (° C.) which, when combined with platinum (Pt) and one or more active elements, should increase the melting temperature of the overall electrode material. The high-melting point elements can also strengthen the electrode material. Each of the high-melting point elements may be present in the electrode material in an amount from about 0.01 at % to about 30 at %, inclusive.

In one embodiment, the electrode material includes a high-melting point element in the form of ruthenium (Ru), which has a melting point of approximately 2310° C. That is not to say that other high-melting point elements cannot be added as well, only that Ru may be included in an amount from about 0.01 at % to about 20 at %, inclusive. The electrode material may include Ru in an amount greater than 0.1 at %; Ru in an amount greater than 5.0 at %; Ru in an amount greater than 14.6 at %; Ru in an amount less than 20.0 at %; or Ru in an amount less than 5.3 at %. Some initial testing has shown that providing an electrode material with Ru in amount from about 4 at % to about 10 at % may be desirable. The electrode material may also include one or more other high-melting point element(s), including Ir, W, Mo, Re, Ta, Nb, Cr, or combinations thereof, so that the combined high-melting point elements are present in a total amount from about 0.01 at % to about 30 at %, inclusive.

In a different embodiment, the electrode material includes a high-melting point element in the form of iridium (Ir), which has a melting point of approximately 2410° C. and is present in the electrode material in an amount from about 0.01 at % to about 30 at %, inclusive. The electrode material may include Ir in an amount greater than 0.01 at %; Ir in an amount greater than 7.2 at %; Ir in an amount greater than 20.2 at %; Ir in an amount less than 30.0 at %; Ir in an amount less than 27.6 at %; or Ir in an amount less than 12.4 at %. The electrode material may also include one or more other high-melting point element(s), including Ru, W, Mo, Re, Ta, Nb, Cr, or combinations thereof, so that the combined high-melting point elements are present in a total amount from about 0.01 at % to about 30 at %, inclusive.

The electrode material may also include a high-melting point element in the form of tungsten (W), which has a melting temperature of approximately 3407° C. and may be present in the electrode material in an amount from about 0.01 at % to about 10 at %, inclusive. Depending on the particular embodiment, the electrode material may include W in an amount that is greater than 0.01 at %; W in an amount greater than 4.1 at %; W in an amount greater than 7.3 at %; W in an amount less than 10.0 at %; W in an amount less than 7.5 at %; or W in an amount less than 4.8 at %, to cite several quantitative possibilities. The electrode material may also include one or more other high-melting point element(s), including Ru, Ir, Mo, Re, Ta, Nb, Cr, or combinations thereof, so that the combined high-melting point elements are present in a total amount from about 0.01 at % to about 30 at %, inclusive.

In yet another embodiment, the electrode material includes a high-melting point element in the form of rhenium (Re), which has a melting point of approximately 3180° C. and is present in the electrode material in an amount from about 0.01 at % to about 10 at %, inclusive. The electrode material may include Re in an amount greater than 0.01 at %; Re in an amount greater than 2.2 at %; Re in an amount greater than 7.5 at %; Re in an amount less than 10.0 at %; Re in an amount less than 6.1 at %; or Re in an amount less than 4.3 at %. The electrode material may also include one or more other high-melting point element(s), including Ru, Ir, Mo, W, Ta, Nb, Cr, or combinations thereof, so that the combined high-melting point elements are present in a total amount from about 0.01 at % to about 30 at %, inclusive.

It is also possible for the electrode material to include a high-melting point element in the form of molybdenum (Mo), which has a melting point of approximately 2617° C. and is present in the electrode material in an amount from about 0.01 at % to about 30 at %, inclusive. The electrode material may include Mo in an amount greater than 0.01 at %; Mo in an amount greater than 7.2 at %; Mo in an amount greater than 20.2 at %; Mo in an amount less than 30.0 at %; Mo in an amount less than 27.6 at %; or Mo in an amount less than 12.4 at %. The electrode material may also include one or more other high-melting point element(s), including Ru, Ir, Re, W, Ta, Nb, Cr, or combinations thereof, so that the combined high-melting point elements are present in a total amount from about 0.01 at % to about 30 at %, inclusive.

In a different embodiment, the electrode material includes a high-melting point element in the form of tantalum (Ta), which has a melting point of approximately 2996° C. and is present in the electrode material in an amount from about 0.01 at % to about 10 at %, inclusive. The electrode material may include Ta in an amount greater than 3.4 at %; Ta in an amount greater than 8.3 at %; Ta in an amount less than 10.0 at %; Ta in an amount less than 7.8 at %; or Ta in an amount less than 3.3 at %. The electrode material may also include one or more other high-melting point element(s), including Ru, Ir, Re, W, Mo, Nb, Cr, or combinations thereof, so that the combined high-melting point elements are present in a total amount from about 0.01 at % to about 30 at %, inclusive.

The electrode material may also include a high-melting point element in the form of niobium (Nb), which has a melting point of approximately 2468° C. and is present in the electrode material in an amount from about 0.01 at % to about 10 at %, inclusive. Depending on the particular embodiment, the electrode material may include Nb in an amount greater than 0.01 at %; Nb in an amount greater than 3.7 at %; Nb in an amount greater than 7.4 at %; Nb in an amount less than 10.0 at %; Nb in an amount less than 5.8 at %; or Nb in an amount less than 2.3 at %. The electrode material may also include one or more other high-melting point element(s), including Ru, Ir, Re, W, Mo, Ta, Cr, or combinations thereof, so that the combined high-melting point elements are present in a total amount from about 0.01 at % to about 30 at %, inclusive.

According to one more embodiment, the electrode material includes a high-melting point element in the form of chromium (Cr), which has a melting point of approximately 1857° C. and is present in the electrode material in an amount from about 0.01 at % to about 10 at %, inclusive. The electrode material may include Cr in an amount greater than 0.01 at %; Cr in an amount greater than 1.2 at %; Cr in an amount greater than 5.3 at %; Cr in an amount less than 10.0 at %; Cr in an amount less than 5.8 at %; or Cr in an amount less than 3.1 at %. The electrode material may also include one or more other high-melting point element(s), including Ru, Ir, Re, W, Mo, Ta, Nb, or combinations thereof, so that the combined high-melting point elements are present in a total amount from about 0.01 at % to about 30 at %, inclusive.

As mentioned above several times, it is possible for the electrode material or Pt-based alloy to have more than one high-melting point element. For example, the electrode material may include both Ru and Cr, in an amount of about 0.01 at % to 20.0 at % for the Ru and about 0.01 at % to 10.0 at % for the Cr. The Ru and Cr constituents may have the following quantities, for example: Ru and Cr in amounts greater than 0.01 at %; Ru in an amount greater than 5.0 at % and Cr in an amount greater than 0.03 at %; Ru in an amount greater than 0.05 at % and Cr in an amount greater than 6.5 at %; Ru in an amount less than 20.0 at % and Cr in an amount less than 10.0 at %; Ru in an amount less than 15.4 at % and Cr in an amount less than 3.2 at %; Ru in an amount less than 5.6 at % and Cr in an amount less than 9.5 at %. The electrode material may also include one or more other high-melting point element(s), including Ir, Re, W, Mo, Ta, Nb, or combinations thereof, so that the combined high-melting point elements are present in a total amount from about 0.01 at % to about 30 at %, inclusive. Electrode material embodiments having three, four, five or more high-melting point elements are envisioned as well.

The electrode material or Pt-based alloy may further include additives or impurities in an amount such that the thin oxide layer is formed at the outer surfaces of the electrodes or firing tips 20, 30 and provides the spark plug with the improved erosion rate. The electrode material may be a solid solution with a single homogeneous phase. The electrode material may have a ductility that allows the material to easily be cold-extruded and formed into different shapes for use in and with spark plug electrodes. In some embodiments, the electrode material is free of an intermetallic or second phase.

Table I below includes a number of exemplary embodiments of the electrode material or Pt-based alloy; other embodiments and compositions are certainly possible.

TABLE I

| | Al (at %) | Ru (at %) | Cr (at %) | Pt (at %) |
|---|---|---|---|---|
| Example 1 | 5.0-10.0 | 0.1-20.0 | | balance |
| Example 2 | 5.0-10.0 | 0.1-10.0 | | balance |
| Example 3 | 5.0-10.0 | 5.0-5.0 | | balance |
| Example 4 | 7.0 | 4.0 | | balance |
| Example 5 | 5.0-10.0 | | 0.1-10.0 | balance |
| Example 6 | 5.0-10.0 | | 0.1-5.0 | balance |
| Example 7 | 7.0 | | 4.0 | balance |
| Example 8 | 5.0-10.0 | 0.1-20.0 | 0.1-10.0 | balance |
| Example 9 | 5.0-10.0 | 0.1-10.0 | 0.1-10.0 | balance |
| Example 10 | 5.0-10.0 | 0.1-5.0 | 0.1-10.0 | balance |
| Example 11 | 5.0-10.0 | 0.1-5.0 | 0.1-5.0 | balance |
| Example 12 | 7.0 | 4.0 | 4.0 | balance |
| Example 13 | 8.0 | 5.0 | 6.0 | balance |
| Example 14 | 7.0 | 10.0 | | balance |
| Example 15 | 7.0 | 15.0 | | balance |
| Example 16 | 7.0 | 20.0 | | balance |
| Example 17 | 7.0 | 30.0 | | balance |
| Example 18 | 7.0 | 40.0 | | balance |

The erosion rates of a number of exemplary electrodes—some of which are formed with the electrode material described above, some of which are formed with other electrode materials—are listed in Table 2. This provides a comparison in terms of erosion rate between two examples of the present electrode material or Pt-based alloy (Pt-7Al-4Ru and Pt-7Al-4Cr) and other competitive materials (Ir-2Rh, Pt-4W, Pt-10Ni, Pt-30Ni, Ni125, Haynes 214, Inconel 600). As previously mentioned, in addition to demonstrating acceptable erosion resistance, the electrode material described herein generally has more desirable ductility attributes than some of the other materials and minimizes the balling or bridging effects sometimes experienced.

The first two entries in Table II are examples of the present electrode material (Pt-7Al-4Ru and Pt-7Al-4Cr) and respectively have melting temperatures of 1797° C. and 1769° C. and erosion rates of 0.4 $\mu m^3$/spark and 0.6 $\mu m^3$/spark. The next seven entries in Table II are comparative alloys and materials (Ir2Rh, Pt20Ni, Pt10Ni, Pt4W, Incone160, Haynes, and Ni125) that may also be used in the formation of spark plug electrodes. Their respective melting points and erosion rates are provided as well.

TABLE II

| Materials | Composition (at %) | Melting Temp. (C.) | Erosion Rate ($\mu m^3$/spark) |
|---|---|---|---|
| Pt7Al4Ru | Pt + 7.0Al + 4.0Ru | 1797° C. | 0.4 $\mu m^3$/spark |
| Pr7Al4Cr | Pt + 7.0Al + 4.0Cr | 1769° C. | 0.6 $\mu m^3$/spark |
| Ir2Rh | Ir + 3.7Rh | 2410° C. | 0.5 $\mu m^3$/spark |
| Pt30Ni | Pt + 59Ni | 1527° C. | 4.4 $\mu m^3$/spark |
| Pt10Ni | Pt + 32Ni | 1677° C. | 2.6 $\mu m^3$/spark |
| Pt4W | Pt + 4W | 1800° C. | 0.9 $\mu m^3$/spark |
| Inconcel ® 600 | Ni + 18Cr + 8Fe + (<1.0)Si + (<0.45)Cu + (<0.7)C | 1354° C. | 8.9 $\mu m^3$/spark |
| Haynes 214 | Ni + 18Cr + 9Al + 3Fe + (<0.5)Mn + (<0.4)Si + (<0.2)C + (<0.06)Zr + (<0.05)B + 0.006Y | 1358° C. | 6.0 $\mu m^3$/spark |
| NiSiAlY | Ni + 3Al + 3Si + 0.06Y | 1450° C. | 4.6 $\mu m^3$/spark |

Spark plug electrodes made from the present electrode material and spark plug electrodes made from the comparative alloys were tested under conditions similar to those of an internal combustion engine. The erosion rate was tested by hot sparking at 710° C. with a spark voltage of 20 KV for 300 hours. The temperatures of the electrodes were maintained at approximately 710° C., which is a typical operating temperature of an electrode of a spark plug 10, for the entire 300 hours. The sparking frequency was 158 Hz. The erosion rate is equal to the amount of material of the sample worn away per spark applied to the sample, and it is measured in $\mu m^3$/spark. The erosion rate of the sample includes rate of erosion due to sparking and rate of erosion due to oxidation. The erosion rates of electrodes formed from the electrode material or Pt-based alloy described herein and the erosion rates of electrodes made from comparative alloys are also shown in Table II.

The test results indicate that the present electrode material, complete with its thin oxide layer, exhibits an enhanced erosion resistance and prevents balling and bridging at the sparking surfaces of the electrodes, such as firing tips 20, 30. An oxide layer developed at the outer surface of the electrodes that were formed from the present electrode material during the erosion rate test; more specifically, when the material was heated to a temperature of about 710° C. These electrodes did not experience significant balling and bridging at the outer surface of the electrode. With reference to Table II, it can be seen that the two examples of the present electrode material (Pt-7Al-4Ru and Pt-7Al-4Cr) exhibit spark erosion rates that are less than the majority of the comparative alloys, and are significantly less than those of Pt30Ni, Pt10Ni, Inconcel® 600, Haynes 214 and NiSiAlY. One potential explanation for the advantageous erosion resistance is the formation of the thin oxidation layer on the surface of the electrode material, as discussed above. It should also be pointed out that because the present electrode material is a Pt-based alloy, it may exhibit superior ductility and metal forming properties than some of the other alloys, particularly the Ir-based alloys like Ir2Rh.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell, wherein the center electrode, the ground electrode, or both includes an electrode material having:

platinum (Pt) from about 50 at % to about 99.9 at %, inclusive;

at least one active element from about 0.01 at % to about 30 at %, the at least one active element is selected from the group consisting of: aluminum (Al) or silicon (Si);

at least one high-melting point element from about 0.01 at % to about 30 at %, inclusive, the at least one high-melting point element is selected from the group consisting of: ruthenium (Ru), iridium (Ir), tungsten (W), molybdenum (Mo), rhenium (Re), tantalum (Ta), niobium (Nb) or chromium (Cr); and a thin oxidation layer formed on or near an electrode surface after the spark plug has been exposed to sufficient heat in a combustion chamber, and the thin oxidation layer minimizes a balling or bridging phenomena that can otherwise take place due to excessive evaporation and re-deposition of certain constituents of the electrode material.

2. The spark plug of claim 1, wherein the at least one active element is aluminum (Al) and is present in the electrode material from about 5 at % to about 10 at %, inclusive.

3. The spark plug of claim 2, wherein the at least one active element is aluminum (Al) and is present in the electrode material at about 7 at %.

4. The spark plug of claim 1, wherein the at least one high-melting point element is ruthenium (Ru) and is present in the electrode material from about 0.1 at % to about 20 at %, inclusive.

5. The spark plug of claim 4, wherein the at least one high-melting point element is ruthenium (Ru) and is present in the electrode material at about 4 at %.

6. The spark plug of claim 4, wherein the at least one high-melting point element is ruthenium (Ru) and is present in the electrode material at about 10 at %.

7. The spark plug of claim 1, wherein the at least one high-melting point element is chromium (Cr) and is present in the electrode material from about 0.1 at % to about 10 at %, inclusive.

8. The spark plug of claim 7, wherein the at least one high-melting point element is chromium (Cr) and is present in the electrode material at about 4 at %.

9. The spark plug of claim 1, wherein the at least one high-melting point element includes ruthenium (Ru) and chromium (Cr) and the combined amount of Ru and Cr in the electrode material is from about 0.1 at % to about 30 at %, inclusive.

10. The spark plug of claim 1, wherein the thin oxidation layer is an aluminum oxide ($Al_2O_3$) layer that forms at a temperature of more than about 500° C. and the aluminum oxide layer is formed on an outer surface of the center electrode, the ground electrode, or both.

11. The spark plug of claim 10, wherein the aluminum oxide ($Al_2O_3$) layer has a thickness of about 0.10 to 10.0 microns (μm).

12. The spark plug of claim 10, wherein the center electrode, ground electrode or both includes a gradient structure where an interior of the electrode includes the active element aluminum (Al) in an amount of about 5.0 at % to about 10.0 at %, and an outer surface of the electrode includes the aluminum oxide ($Al_2O_3$) layer.

13. The spark plug of claim 1, wherein the electrode material includes a solid solution with a single homogeneous phase.

14. The spark plug of claim 1, wherein the platinum (Pt) is present in the electrode material from about 75 at % to about 95 at %, inclusive, the at least one active element is aluminum (Al) and is present in the electrode material from about 5 at % to about 10 at %, inclusive, and the at least one high-melting point element is ruthenium (Ru) and is present in the electrode material from about 0.1 at % to about 10 at %, inclusive.

15. The spark plug of claim 14, wherein the aluminum (Al) is at about 7 at % and the ruthenium (Ru) is at about 4 at %.

16. The spark plug of claim 14, wherein the aluminum (Al) is at about 7 at % and the ruthenium (Ru) is at about 10 at %.

17. The spark plug of claim 1, wherein the center electrode, the ground electrode, or both includes an attached firing tip that is at least partially made from the electrode material.

18. The spark plug of claim 17, wherein the firing tip is a multi-piece rivet that includes a second component attached to the center electrode or the ground electrode, and a first component that is attached to the second component and is at least partially made from the electrode material.

19. The spark plug of claim 1, wherein the center electrode, the ground electrode, or both is at least partially made from the electrode material and does not include an attached firing tip.

20. An electrode material for use with a spark plug, comprising:

platinum (Pt) from about 50 at % to about 99.9 at %, inclusive;

at least one active element from about 0.01 at % to about 30 at %, the at least one active element is selected from the group consisting of: aluminum (Al) or silicon (Si);

at least one high-melting point element from about 0.01 at % to about 30 at %, inclusive, the at least one high-melting point element is selected from the group consisting of: ruthenium (Ru), iridium (Ir), tungsten (W), molybdenum (Mo), rhenium (Re), tantalum (Ta), niobium (Nb) or chromium (Cr); and a thin oxidation layer formed on or near an electrode surface after the spark plug has been exposed to sufficient heat in a combustion chamber, and the thin oxidation layer minimizes a balling or bridging phenomena that can otherwise take place due to excessive evaporation and re-deposition of certain constituents of the electrode material.

* * * * *